United States Patent [19]

Burns

[11] Patent Number: 4,603,934

[45] Date of Patent: Aug. 5, 1986

[54] FACE SEAL PRESSURE APPARATUS FOR ELECTRICAL CONNECTORS

[75] Inventor: Edgar Burns, Los Angeles, Calif.

[73] Assignee: G & H Technology, Inc., Santa Monica, Calif.

[21] Appl. No.: 723,192

[22] Filed: Apr. 15, 1985

[51] Int. Cl.[4] ..... H01R 13/625

[52] U.S. Cl. ..... 339/90 R; 339/89 M

[58] Field of Search ..... 339/DIG. 2, 89 R, 89 C, 339/89 M, 90 R, 90 C

[56] References Cited

U.S. PATENT DOCUMENTS

| | | | |
|---|---|---|---|
| 3,611,260 | 10/1971 | Colardeau | 339/89 R |
| 3,663,926 | 5/1972 | Brandt | 339/89 R |
| 3,945,703 | 3/1976 | McCormick | 339/89 M |
| 4,059,332 | 11/1977 | Phillips et al. | 339/89 M |
| 4,277,125 | 7/1981 | Ball | 339/113 R |
| 4,506,943 | 3/1985 | Drogo | 339/DIG. 2 |
| 4,521,066 | 6/1985 | Kempe | 339/DIG. 2 |

*Primary Examiner*—John McQuade

*Attorney, Agent, or Firm*—George J. Netter

[57] ABSTRACT

In a plug and receptacle connector, directly couple to the threads of the coupling ring with threads on the driven portion of the connector (e.g., plug), without a coupling nut, and insert a spring intermediate at least one of the threads on the coupling ring and the driven portion. A split-wave spring having corrugated legs may be used. Another feature is to provide notches on the thread facing the wave spring legs to receive the end of the respective leg for preventing the spring from slipping out of the threads.

9 Claims, 5 Drawing Figures

FACE SEAL PRESSURE APPARATUS FOR ELECTRICAL CONNECTORS

FIELD OF THE INVENTION

The present invention relates to an improvement in electrical connectors employing a coupling ring to tighten the connector into a mated position and provide sufficient pressure at the faces within the connector containing the pin and socket contacts to seal the faces together.

BACKGROUND AND SUMMARY OF THE INVENTION

Various methods are known in the art for providing enough pressure on the face seal of an electrical connector to prevent, e.g., dirt or moisture from fouling or otherwise damaging the pin and socket contacts of the connector or shorting adjacent contacts. In most screw-type circular connectors there is employed a coupling ring which is tightened down hard enough to place the seal face, e.g., on the portion of the connector having the pin contacts under sufficient pressure against the socket insulator in the other portion of the connector to accomplish the desired sealing. One or both of the sealing faces typically have a resilient material covering all or portions of the faces, which provides the sealing effect when put under pressure by the faces being forced against each other. Over the life of the connector, as the resilient material takes a set, the sealing pressure on the faces will become less effective in providing the required sealing. This results in the coupling ring being required to be tightened further in order to maintain the desired sealing.

On certain connectors, e.g., a Series IV Mil-38999, manufactured by the assignee of the present invention, the coupling ring is designed to be rotated a specific amount during mating. Subsequent loss of sealing pressure at the contact faces due, e.g., to the elasastomeric material taking a set over time, cannot be corrected by futher tightening of the coupling ring in such a connector.

In the past, it has been the practice in such connectors, as is shown, e.g., in U.S. Pat. No. 4,277,125 (assigned to the assignee of the present invention, the disclosure of which is hereby incorporated by reference) to provide an internal spring loaded coupling nut. The nut is positioned intermediate the coupling ring and the driven portion of the connector driven by the coupling ring. It is threaded to both and rotation of the coupling ring drives the driven portion of the connector into the mating (and sealing) position. It will be understood that the driven portion of the connector may be, as shown in the '125 patent referred to above, the plug portion containing socket contacts. But the plug portion is so defined by connection because it contains an insert, having the contact containing face, which fits into an insert in the other, receptacle, portion of the connector. Either of the plug portion and receptacle portion would be the driven portion and either could contain socket contacts with the other than containing pin contacts, or perhaps corresponding pin in socket contacts could be contained in both. Whatever the construction of the driven portion and its associated other portion of the connector, there has been utilized in the past a wave spring coacting with the coupling ring and the coupling nut to bias the driven portion of the connector into face sealing engagement with the other portion of the connector, by exerting a spring force in the mating direction on the coupling nut after the coupling ring is rotated to the fully mated position. This spring biasing accounts for changes in the effective face sealing over the life of the connector.

While effective in maintaining the face seal, the prior arts connector of the '125 patent, employing the spring biased coupling nut has several drawbacks. For one, the '125 patent demonstrates that the construction is costly to manufacture. The various alignment lands and grooves, keys and keyways, necessary for interfacing the coupling ring, coupling nut and driven portion of the connector, as an example, increase the overall manufacturing cost of the connector. In addition, the utilization of a coupling nut, whether spring biased or not, increases the overall diameter of the connector. This may prohibit its use, e.g., where multiple connectors are grouped together in a limited space.

Recognizing the need for an improved face seal pressure device for utilization in connectors employing a coupling ring, especially one where the coupling ring, in order to guarantee the operator will not over-torque the connector, is one which by design cannot rotate more than a certain amount. The object of the present invention is to provide such a face seal pressure device. A feature of the present invention is to directly couple the threads of the coupling ring and threads on the driven portion of the connector, without a coupling nut, and to insert a spring means intermediate at least one of the threads on the coupling ring, and the driven portion of the connector. A typical split wave spring may be used as may be the split wave spring specifically designed for the present invention, having corrogated legs. Another feature of the invention is to provide a means for preventing the spring means from slipping out of the threads by, e.g., providing notches on the particular thread facing the wave spring legs to receive the end of the respective leg.

The above described features and advantages of the present invention have been given rather broadly in order that the more detailed description given below may be better understood and the contribution to the art better appreciated. These and other features of the invention will be apparent to those skilled in the art by reference to the detailed description below in conjunction with the drawing, in which like reference numerals are used to designate to like elements and in which:

DETAILED DESCRIPTION OF THE PREFERRED EMBODIMENT

Figure 1:
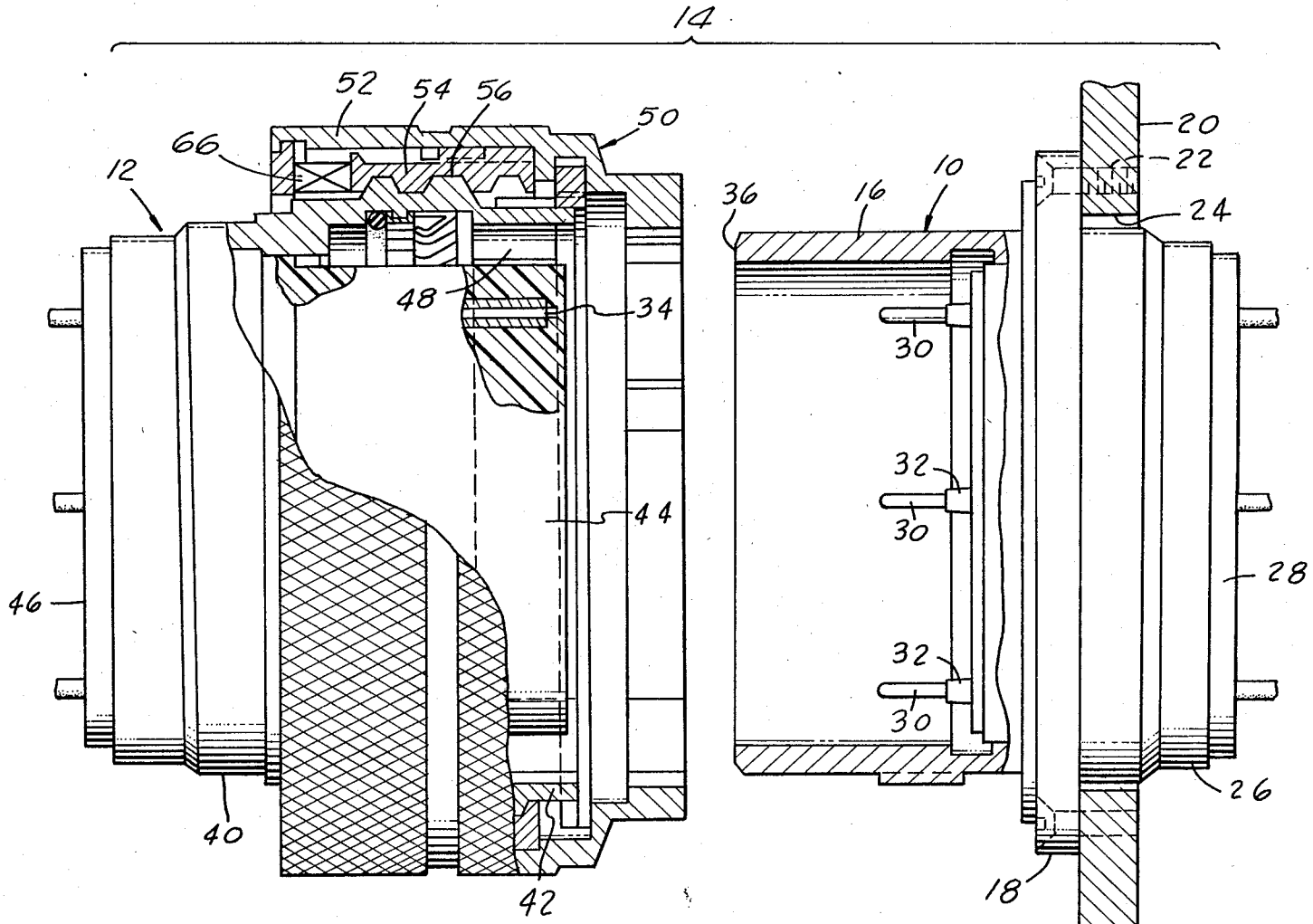
FIG. 1 (PRIOR ART)
FIG. 1 shows a prior art connector as shown in the '125 patent, having a coupling ring, coupling nut and driven portion of the connector, with the coupling nut spring biased in the mating direction.

In FIG. 1 is shown a prior art receptacle 10 coaxially aligned with and separated from a plug 12, both receptacle 10 and the plug 12 providing an electrical connector generally indicated at 14. The electrical connector 14 serves to couple and electrically connected a plurality of cables or wires, the ends of which are secured to the recptacle 10 and the plug 12 at electrical contact elements in a known manner. Three cables are shown for coupling by the connector 14, it being understood that the bundle of cables may vary in number and can include as many as 20 cables or more. The plug 12 is adapted to be advanced along the axis of receptacle 10 to move the plug 12 into desired full electrical and mechanical mating of the plug 12 and/or the receptacle 10.

The receptacle 10 includes a receptacle shell 16 comprising a cylindrical wall having a radially outwardly directed annular flange 18 which may be placed against the front face of wall 20 and secured thereto by screw bolts 22. Receptacle shell 16 extends through an opening 24 in wall 20 and may include a back cylindrical shell wall 26 which extends beyond the back face of wall 20.

Receptacle shell 16 receives and holds a composite insert member 28 of cylindrical form. The insert member 28 is restricted against axial movement and retained as is more fully described in the '125 patent.

The front portion of insert member 28 may be made of a resilient dielectric material and the back portion made of a relatively hard dielectric material. Contact pins 30 project from conical bosses 32 of the resilient material, the bosses 32 providing circular sealing contact with hard dielectric material surrounding corresponding socket contacts 34 in the plug portion 12. The axial position of insert member 28 in receptacle shell 16 is such that contact pins 30 carried thereby have their pin ends spaced a predetermined distance inwardly from the edge face 36 of receptacle shell 16. Contact pins 30 are thereby exposed for mating contact with the plug member 12 relatively deeply within the chamber formed by receptacle shell 16 and are protectively enclosed by receptacle shell 16.

Sets of locking lands and locking faces (not shown) may be provided and the lands may be varied to provide a specific different set of lands for receptacles having selected pin contact arrangements or other differing characteristics to avoid mismatching of receptacle and plug means as is more fully described in the '125 patent.

A master key 50 is provided to angularly orient the plug and the receptacle as described in the '125 patent.

The interconnection at the insert member between the cables, insert member 28 and contact pins 30 may be made in suitable wellknown manner. It is understood that insert member 28 firmly holds the contact pins 30 against relative axial movement and that electrical continuity is preserved through insert member 28 without electrical leakage loss.

Plug 12 comprises a plug shell 40 having a particularly configured cylindrical wall 42 having an internal diameter slightly greater than the outer diameter of receptacle shell 16 so that shell 16 may be axially and telescopically received therewithin. The plug housing 40 is aligned, seated and held against axial movement in the plug 12, as described in the '125 patent. A cylindrical plug insert member 44 of suitable hard dielectric material receives ends of cables which are electrically connected within insert member 44 to electrical socket contacts 34 spaced and arranged about the axis of the plug insert member 44 to correspond with the spacing and arrangement of the contact pins 30 on the receptacle insert member 28. The cylindrical portion of plug insert member 44 has an outer diameter which is slightly less than the inner diameter of receptacle shell 16. The outer cylindrical surface of insert member portion 44 defines with the internal cylindrical surface of cylindrical wall 42 of plug housing 40 an annular space 48 for reception of receptacle shell 16 during mating of the plug 12 and receptacle 10.

Plug 12 also includes means for coupling or connecting the plug 12 and receptacle 10 whereby the pin and socket contacts 30 and 34 respectively are properly aligned for electrical mating contact when the receptacle and plug shells 16 and 40 respectively are coaxially drawn together into full electrical mating and mechanical locking engagement. The coupling means of the prior art connector 14 generally indicated at 50 includes a coupling ring housing 52 and a coupling nut 54 within coupling ring 52 and provided with threaded engagement at 56 with external threads provided on cylindrical wall 42 of plug housing 40. Coupling ring 52, when turned about the axis of the connector 14, will transmit such turning forces through coupling nut 54 to interleaved lands and grooves of the plug housing while preventing relative longitudinal or axial movement between coupling ring and coupling nut, as is described in the '125 patent.

The threaded engagement at 56 between plug housing 40 and coupling nut 54 comprises a four lead fast thread adapted to rapidly axially advance plug shell 40 into full mated relationship with receptacle shell 16 upon rotation of coupling ring housing 52. An example of a suitable thread used in such prior art connectors is an Acme stub thread.

Electrical continuity with respect to grounding and radio frequency interference shielding may be carried within plug shell 40 for engagement with receptacle shell 16 as is more fully described in the '125 patent.

Advancement of the plug 12 into full electrical contact of the contact pins 30 and contact sockets 34 is accomplished by turning the coupling ring 52 in one direction through about 90 degrees. Turning of coupling ring housing 52 drives the coupling nut 54 which moves plug housing 40 axially without rotation towards the receptacle 10. Plug housing 40 is held against rotation by interlocking of keys and keyways in the plug 12 and receptacle as described in the '125 patent. Upon completion of turning the coupling ring through 90 degrees, relative axial movement of the coupling ring with respect to the plug housing is thereby prevented, as described in the '125 patent.

Figure 2:
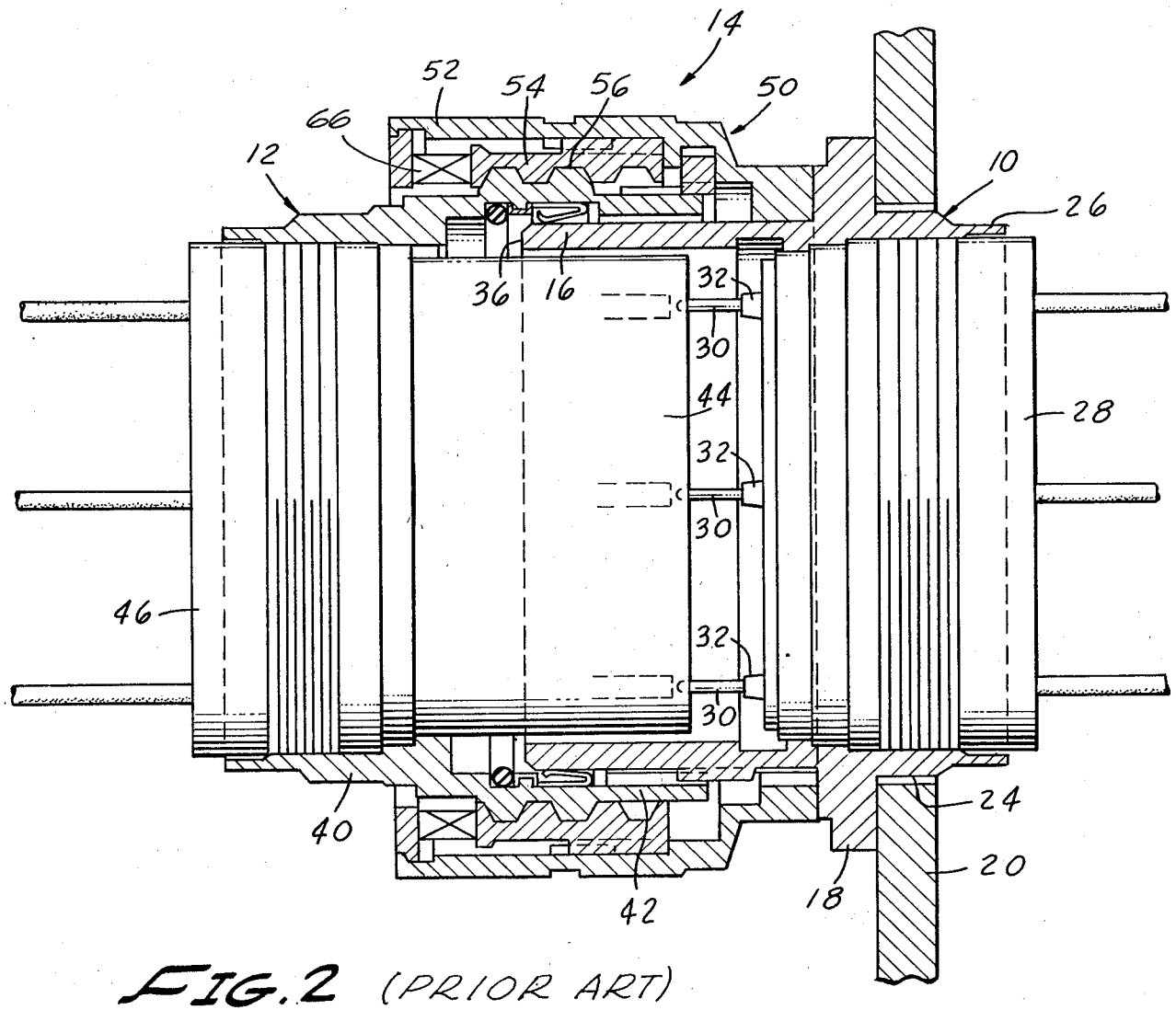
FIG. 2 (PRIOR ART)
FIG. 2 shows the prior art connector of FIG. 1, with the plug portion of the connector (the driven portion) inserted into the receptacle portion, just prior to rotation of the coupling ring to complete the mating of the connector.

Turning now to FIG. 2, the prior art connector 14 of FIG. 1 is shown with the plug portion 12 inserted into the receptacle portion 10, prior to the rotation of the coupling ring 52. Upon rotation of the coupling ring 52 in the prior art connector 14, the coupling nut 54 acts to drive the driven plug portion 12 of the connector 14 into the fully mated position, with face sealing accomplished, e.g., by the resilient material 32 surrounding the pin contacts 32 coacting with the material forming the socket contacts 34. The spring biasing of wave spring 66 acting against the coupling nut 54, maintains the face sealing within the connector 14.

Figure 3:
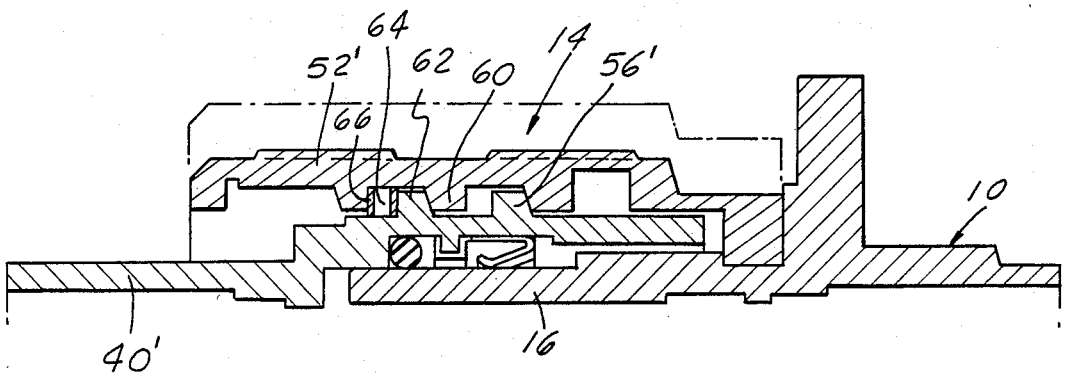
FIG. 3 shows the improved connector of the present invention, having at least one spring biasing means intermediate at least one of the threads on the coupling ring and the corresponding thread or threads on the driven portion of the connector, which are coacting directly without a coupling nut.

Turning now to FIG. 3, there is shown the inproved connector 14 of the present invention in partial cross section, showing only the details of the prior art connector 14 of FIGS. 1 and 2 necessary to illustrate the improvement of the present invention. A receptacle 10 has a cylindrical receptacle shell 16 which receives a plug portion (not shown) of a plug shell 40'. The plug shell 40' has a threaded exterior surface containing thread 56'. A coupling ring 52' has a threaded interior surface with threads 60 which receive and coact with the threads 56' on the plug shell 40' to drive the driven plug portion 12 of the connector 14 into the mated position.

Each of the threads 56' on the plug shell 40' is formed by suitable means known in the art to provide a sufficient opening or spacing 64 between the threads 62 and the threads 60 on the coupling ring '52 such that the coupling ring is loosely meshed with the plug shell. Within a space 64 there is located a spring means 66 which acts to effect resilient meshing of the plug shell with the coupling ring. The spring means 66 may be a wave spring, e.g., of the kind manufactured by Smalley Steel Ring co., Wheeling, Ill. under the model number SSR-XXXX. Such a wave spring 66 is of a circular shape and conforms to the opening 64 around one full helical turn of a thread 60 or 62. It will be understood that for some applications where more face sealing pressure is desired, there may be more than one such spring means 66, only one being shown in FIG. 3.

Figure 4:
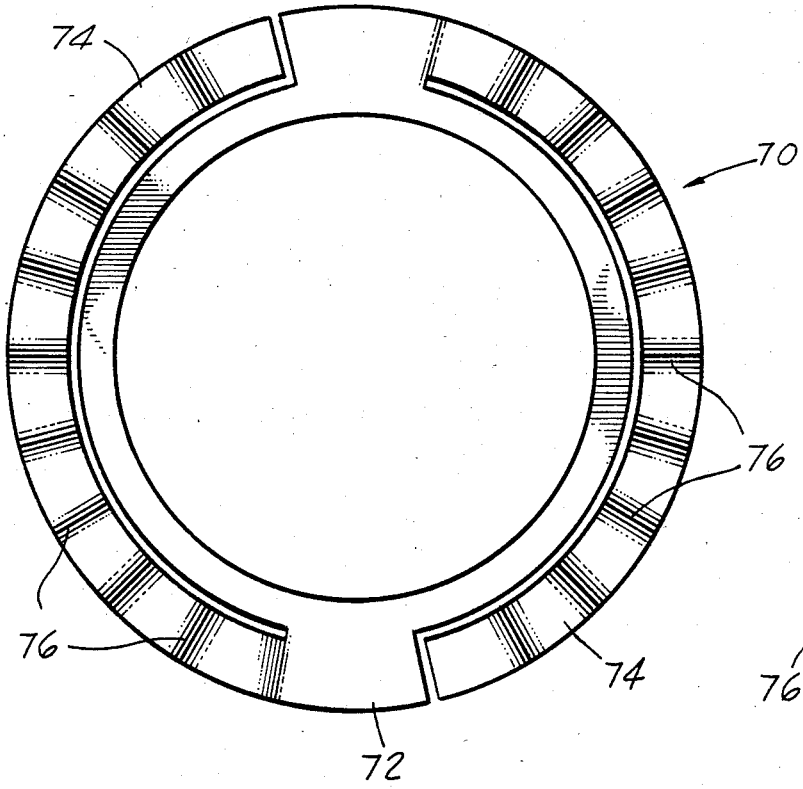
FIGS. 4 and 4A show a wave spring having a plurality of corrogated legs, useful as the spring biasing means according to the present invention.
Figure 4A:
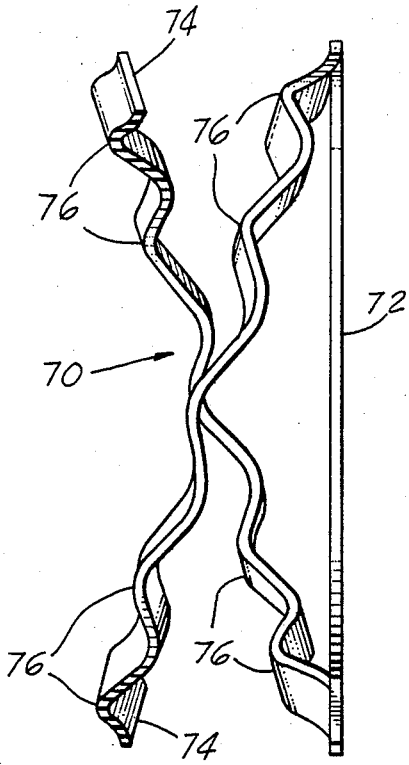

Another spring means 70 suitable for use in the present invention may be formed from a flat, circular ring stock 72 (FIGS. 4, 4A). A pair of legs 74 are partially sheared from the ring stock 72 along a radial line and an arc concentric to the ring stock 72 and bent out of the plane of the ring stock 72 at the end of the leg 74 while remaining connected to the ring stock 72. Each of the legs 74 is then pressed to form corrogations 76 as shown in FIG. 4A. It will be understood that the legs 74 could just as easily be sheared from the ring stock 72 with the radial line extending to the interior of the circular ring stock 72, as opposed to extending from the exterior thereof, as shown in FIG. 4. It will also be understood that three or more legs 74 may be so formed, or if longer legs 74 are desirable or more spring power is desired, two or more such spring means 74 may be stacked with the leg 74 attachment points on each rotated (e.g., 90° when two are stacked) so as to evenly distribute the legs around the opening 64.

The respective side walls of threads 60 and 56' are formed with notches (not shown) which are shaped and positioned to engage and hold the end of a respective one of the legs 72 when the coupling ring 52' is rotated sufficiently to place the legs 72 adjacent their respective notch. This holds the spring means 66 against rotation out of the threads 56', 60.

SUMMARY OF THE SCOPE AND ADVANTAGES OF THE INVENTION

It can be seen that an improved electrical connector is provided which obtains the desired face sealing of the connector by a means which is simple of construction and easy to assemble. Moreover, the overall outer diameter of the connector has been reduced without degrading from the face sealing capability. Those skilled in the art will appreciate that many changes and modifications of the present invention may be made without departing from the scope and intent of the invention. For example, the invention may be useful, as well, in connectors which previously did not rely upon spring biasing for face sealing, i.e., wherein the coupling ring is capable of a variable degree of rotation. In such connectors, over torquing and premature uncoupling under vibration is a problem, which may be alleviated by the use of the present invention with light-hand torquing of the coupling ring and reliance upon the spring biasing means for needed face sealing pressure. Also, while the present invention is conveniently constructed by modifying the threads on one or both of the coupling ring and driven portion of the connector to form an opening for the spring means, the spring means may just as easily be positioned in a space between the coupling ring and driven portion of the connector displaced from the threaded connection of those two.

These and other changes and modifications apparent to those skilled in the art, are intended by the inventor to come within the scope and meaning of the appended claims.

What is claimed is:

1. An electrical connector comprising:

a receptacle portion;

a plug portion adapted to mate with the receptacle portion;

each of the plug receptacle portions having aligned mating contact members positioned on a mating face located on the respective plug portion and receptacle portion;

a locking ring surrounding the plug portion and receptacle portion and having a threaded interiorly facing surface;

a threaded exteriorly facing surface on the one of the plug and receptacle portions positioned adjacent the locking ring, to move the plug portion and receptacle portion into a mated position upon rotation of the locking ring in a first direction; and a face seal biasing spring positioned between at least one thread on each of the threaded interiorly facing surface and the threaded exteriorly facing surface.

2. The apparatus of claim 1 further comprising:

the face seal biasing spring comprises a split wave spring.

3. The apparatus of claim 1 further comprising:

the face seal biasing spring comprises a generally flat ring-shaped member having a plurality of legs partially sheared from the flat member and bent out of the plane of the flat member about a line of attachment to the flat member and the legs having corrugations formed thereon.

4. The apparatus of claim 2 further comprising:

the face seal biasing spring having a plurality of legs each of which has a terminal end;

a plurality of end receiving notches formed in one of the at least one thread on the interiorly facing threaded surface and the exteriorly facing threaded surface, between which is positioned the face seal biasing spring, which notches are positioned to receive and hold a respective one of the terminal ends of the legs, when the locking ring is in the connector fully mated position.

5. The apparatus of claim 3 further comprising:

the face seal biasing spring having a plurality of legs each of which has a terminal end;

a plurality of end receiving notches formed in one of the at least one thread on the interiorly facing threaded surface and the exteriorly facing threaded surface, between which is positioned the face seal biasing spring, which notches are positioned to receive and hold a respective one of the terminal ends of the legs, when the locking ring is in the connector fully mated position.

6. In an electrical connector, having a receptacle portion and a plug portion, each of which contains pin contacts or socket contacts, and the facing between the pin contacts and socket contacts is desirably biased into close fit when the connector is in the mated position, the improvement comprising:

one of the plug portion and the receptacle portion having a threaded exterior surface;

a locking ring having a threaded interior surface surrounding the one of the plug portion and receptacle portion having the threaded exterior surface, with the thread engaging the threads of the locking ring, said locking ring and portion having a threaded exterior surface being loosely meshed enabling axial relative movement; and a spring means, positioned between the locking ring and the portion having a threaded exterior surface for continuously and resiliently biasing the plug and receptacle portion in a direction toward mating when the locking ring is in the connector fully mated position, said spring means including a split wave spring having a generally ringshaped flat member with a plurality of legs partially sheared from the flat member and bent out of the plane of the flat member and with corrugations formed on the legs.

7. In an electrical connector, having a receptacle portion and a plug portion, each of which contains pin contacts or socket contacts, and the facing between the pin contacts and socket contacts is desirably biased into close fit when the connector is in the mated position, the improvement comprising:

one of the plug portion and the receptacle portion having a threaded exterior surface;

a locking ring having a threaded interior surface surrounding the one of the plug portion and receptacle portion having the threaded exterior surface, with the thread engaging the threads of the locking ring, said locking ring and portion having a threaded exterior surface being loosely meshed enabling axial relative movement; and a spring means, positioned between the locking ring and the portion having a threaded exterior surface for continuously and resiliently biasing the plug and receptacle portion in a direction toward mating when the locking ring is in the connector fully mated position, said spring means including a wave spring having a generally ring-shaped flat member with a plurality of legs partially sheared from the flat member and bent out of the plane of the flat member, and with corrugations formed on the legs; and a spring means receiving space formed between a shoulder on the locking ring at one end of the threaded interior surface of the locking ring and a first thread on the threaded exterior surface of the one of the plug and receptacle portions containing the threaded exterior surface.

8. In an electrical connector, having a receptacle portion and a plug portion, each of which contains pin contacts or socket contacts, and the facing between the pin contacts and socket contacts is desirably biased into close fit when the connector is in the mated position, the improvement comprising:

one of the plug portion and the receptacle portion having a threaded exterior surface;

a locking ring having a threaded interior surface surrounding the one of the plug portion and receptacle portion having the threaded exterior surface, with the thread engaging the threads of the locking ring, said locking ring and portion having a threaded exterior surface being loosely meshed enabling axial relative movement; and a spring means, positioned between the locking ring and the portion having a threaded exterior surface for continuously and resiliently biasing the plug and receptacle portion in a direction toward mating when the locking ring is in the connector fully mated position, said spring means including a split wave spring having a plurality of legs each with a terminal end; and a plurality of end receiving notches formed in the first thread of the threaded surface of the one of the threaded inner surfaces on the locking ring and the one of the plug and receptacle portions containing the threaded outer surface which faces the extending legs of the wave spring, which notches are positioned to receive and hold a respective one of the terminal ends of the legs when the locking ring is in the connector fully mated position.

9. In an electrical connector, having a receptacle portion and a plug portion, each of which contains pin contacts or socket contacts, and the facing between the pin contacts and socket contacts is desirably biased into close fit when the connector is in the mated position, the improvement comprising:

one of the plug portion and the receptacle portion having a threaded exterior surface;

a locking ring having a threaded interior surface surrounding the one of the plug portion and receptacle portion having the threaded exterior surface, with the thread engaging the threads of the locking ring, said locking ring and portion having a threaded exterior surface being loosely meshed enabling axial relative movement;

a spring means, positioned between the locking ring and the portion having a threaded exterior surface for continuously and resiliently biasing the plug and receptacle portion in a direction toward mating when the locking ring is in the connector fully mated position, said spring means including a wave spring having a plurality of legs each with a terminal end;

a plurality of end receiving notches formed in the first thread of threaded surface of the one of the threaded inner surfaces on the locking ring and the one of the plug and receptacle portions containing the threaded outer surface which faces the extending legs of the wave spring, which notches are positioned to receive and hold a respective one of the terminal ends of the legs when the locking ring is in the connector fully mated position;

a spring means receiving space formed between a shoulder on the locking ring at one end of the threaded interior surface of the locking ring and a first thread on the threaded exterior surface of the one of the plug and receptacle portions containing the threaded exterior surface.

* * * * *